United States Patent [19]

Nerlich

[11] 4,225,271

[45] Sep. 30, 1980

[54] HYDRAULICALLY OPERATED MINE ROOF SUPPORT AND A CONTROL ARRANGEMENT THEREOF

[75] Inventor: Ernst-Günter Nerlich, Essen, Fed. Rep. of Germany

[73] Assignee: Bochmer Eisennuette Heintzmann GmbH, Bochum, Fed. Rep. of Germany

[21] Appl. No.: 9,692

[22] Filed: Feb. 5, 1979

[30] Foreign Application Priority Data

Feb. 22, 1978 [DE] Fed. Rep. of Germany ..... 2807431

[51] Int. Cl.[3] ..... E21D 23/16

[52] U.S. Cl. ..... 405/302; 91/170 MP

[58] Field of Search ..... 405/291, 299, 300, 301, 405/302; 91/170 MP, 508, 530

[56] References Cited

U.S. PATENT DOCUMENTS

| | | | |
|---|---|---|---|
| 3,309,880 | 3/1967 | Potts et al. | 405/302 |
| 3,821,880 | 7/1974 | Weirich et al. | 405/302 |
| 4,158,326 | 6/1979 | Krieger | 405/302 X |

*Primary Examiner*—David H. Corbin
*Attorney, Agent, or Firm*—Michael J. Striker

[57] ABSTRACT

A control arrangement for a hydraulically operated mine roof support having first and second consumers which require smaller and larger amount of the working medium per time unit, respectively, has first control elements for the first consumers and second control elements for the second consumers. The first control elements include a first bundle of hoses having a small inner diameter and arranged to select and apply pressure to the first consumers directly from a neighboring mine roof support. The second control elements include a second bundle of hoses with a small inner diameter, main control valves indirectly remotely controlled through the second bundle of hoses and arranged to select the second consumers, and conduits extending between the second consumers and the main control valves and arranged to apply pressure to the former. The conduits have an inner diameter which exceeds that of the hoses of the first and second bundles.

11 Claims, 3 Drawing Figures

HYDRAULICALLY OPERATED MINE ROOF SUPPORT AND A CONTROL ARRANGEMENT THEREOF

BACKGROUND OF THE INVENTION

The present invention relates to a mine roof support having hydraulically operated consumers which include displacing cylinder-and-piston units and props, and to a control arrangement of the mine roof support.

Control arrangements for hydraulically operated mine roof supports are known in the art. In known arrangements, a hydraulically operated consumer of a mine roof support (for example, a prop, a return aggregate, or an adjusting unit) is operated directly from a neighboring mine roof support. For this purpose, flexible hoses serving as supply conduits and return conduits extend between a control unit or several control units on the neighboring mine roof support or between a main control valve arranged on the latter, and the several consumers. These hoses have an identical inner diameter for the purpose of standardization and simplicity of mounting and are connected to a consumer whose operation requires a large amount of medium per time unit. Since the latter mentioned consumers are utilized in a smaller number than the consumers with a smaller amount of medium required per time unit, this means that about four fifth of the supply and return conduits are overdimensioned. Therefore, the expenditures for not functionally justified hose conduits are high. It is not only unnecessary to utilize a great number of hose conduits with a larger inner diameter, but correspondingly dimensioned hose joints and main control valves must be utilized in such a construction, which also involves unnecessary expenditures. These expenditures are further increased since in many cases throttles must be incorporated in the hose conduits which lead to consumers with only small amount of medium required per time unit.

Side by side with these operationally determined shortcomings, the known control arrangement has a further disadvantage that a large space between the neighboring mine roof supports is occupied by a plurality of hoses with a large inner diameter. This hinders miners working in the mine and makes difficult the displacement of the mine roof support, especially in the conditions of low strata. Moreover, the great number of hoses in connection with the great space consumption results in raised danger by stonefall and increased risk of damages.

In order to eliminate a part of these short-comings, it has been proposed to transfer the main control valves for the consumers from the neighboring mine roof support to the main mine roof support and to provide only here the connecting conduits between the main control valves and the consumers, and therefore the hoses with a larger inner diameter. However, in this case again the hoses, for the purpose of the standardization and simple mounting, have a diameter which is determined by the consumer which requires the largest amount of medium per time unit. Due to the placing of the main control valves on the main mine roof support the conduits between the neighboring mine roof support and the main control valves on the main mine roof may have smaller inner diameter so that only one clustered strand lies between the mine roof supports. However, an additional pilot valve must be provided on the neighboring mine roof support, with the aid of which the main control valves on the main mine roof support can be actuated in a remote-control manner. At the same time, the main control valves which must match the hoses with a larger inner diameter are also expensive.

SUMMARY OF THE INVENTION

Accordingly, it is an object of the present invention to provide a control arrangement for a hydraulically operated mine roof support, which avoids the disadvantages of the prior art.

More particularly, it is an object of the present invention to provide a control arrangement for a hydraulically operated mine roof support, which maintains the advantage of utilizing a bundle of conduits between two neighboring mine roof supports, and at the same time eliminates the disadvantage of the utilization of conduits with a considerably large inner diameter, as compared with the diameter of the bundle, and of joints and main control valves required for such conduits.

In keeping with these objects and with others which will become apparent hereinafter, one feature of the present invention resides, briefly stated, in a control arrangement for a hydraulically operated mine roof support, in which first control means for consumers requiring a small amount of working medium per time unit and second control means for consumers requiring a large amount of the working medium per time unit are provided, wherein the first control means includes a first bundle of hoses having a relatively small inner diameter and arranged to select and apply pressure to the first consumers, whereas the second control means includes a second bundle of hoses between a main mine roof support and a neighboring mine roof support, main control valves which are indirectly remotely controlled through the second bundle of hoses are arranged to select the second consumers, and conduits having a relatively large inner diameter and extending between the second consumers and the main control valves as well as arranged to apply pressure to the second consumers. A mine roof support is also proposed, provided with such a control arrangement.

In accordance with the present invention, it is essential that the major part of the hydraulically operated consumers is no longer only directly selected and subjected to pressure from the neighboring mine roof support, but for this purpose hoses with a considerably smaller diameter, as compared with known control arrangements, can be utilized. Particularly such hoses can be utilized in the inventive control arrangements which are suitable for transmission of control impulses from the pilot valves on the neighboring mine roof support to the main control valves on the main mine roof support. It is realized in accordance with the inventive concept that for the majority of the consumers of the mine support the inner diameter of such control hoses is sufficient in order to transport the required amount of the working medium during the desired time to the desired consumer or to withdraw the same from the consumer.

In accordance with the invention, the working medium is supplied through the pilot-controlled main control valve to or withdrawn from only such consumer which requires such amount of the working medium per time unit which cannot be mastered any longer from a control hose with a relatively small inner diameter. This means that between both neighboring mine roof supports only a bundle of hoses having a small inner diameter can be arranged, and the mine roof support itself has only relatively few remotely controlled main control valves from which conduits extend leading to the consumers and having a larger inner diameter.

The control arrangement in accordance with the present invention retains the basic advantage of the bundle of hoses. However, they are not utilized in a great number as directly connecting conduits between at least one control unit on the neighboring mine roof support and the consumers, but only in a small number as control conduits for remotely controlling main control valves on the main mine roof support. These measures lead to a reduction of the large joints and to a smaller number of the main control valves whose dimensions are determined in accordance with the hoses with a larger inner diameter.

Another advantageous feature of the present invention is that the bundle of hoses connects a multiple-way control unit on the neighboring mine roof support, with a distributor unit on the main mine roof support. At the same time, conduits with a smaller diameter are provided between the distributor unit and the consumers which require a small amount of a working medium per time unit, whereas further conduits having an inner diameter which is from two to three times larger than the inner diameter of the first-mentioned circuits are provided between the distributor unit and the consumers which require a larger amount of the working medium per time unit with interposition of the pilot-operated main control valves.

The distributor unit is so constructed that it, without or with only a small number of parts is operative for transmission of the working medium through conduits between the distributor unit and the consumers, or withdrawal of the medium from these conduits into the above-mentioned bundle. For this purpose, the distributor unit can be provided with passages corresponding to the number and shape of the consumers so that by coupling of the bundle of hoses with the distributor unit each individual hose of the bundle communicates through a respective passage with a respective further conduit. Furthermore, the distributor unit guarantees that for the consumers which require a large amount of the working medium per time unit the working medium, through the corresponding hoses of the bundle, will be supplied to the main control valves on the main mine roof support. The main control valves may be, for this purpose, incorporated in the distributor unit. The conduits between the distributor unit and the consumers are preferably formed as hose conduits.

Fast coupling of the bundle of hoses with and uncoupling the same from the distributor unit is attained so that the end portions of the bundle extend into plug connectors which are connectable with a receiving portion of the multiple-way control unit, on the one hand, and a receiving portion of a distributor unit, on the other hand. Thus, the bundle of hoses can be conveniently and completely connected with or disconnected from the control unit and distributor unit as a whole. Therefore, the maintenance and repair works which are conventionally time-consuming are essentially reduced.

The consumers which require a large amount of the working medium per time unit are formed, as a rule, by setting spaces of the props and a front space in front of a piston of a displacing unit of the mine roof support. Thereby, on the one hand, the required setting pressure is attained fast so that the requirement of safety can be satisfied to a great extent, and, on the other hand, the mine roof support, such as a walking frame, a support frame or a shield unit can be displaced fast to a new position. The mine roof therefore remains unsupported for only short time in the region of the displaceable mine roof support.

It is further advantageous that the conduits which lead to the consumer requiring a small amount of the working medium per time unit have an inner diameter equal to substantially between four and six millimeters, whereas the conduits which lead to the consumers requiring a larger amount of the working medium per tine unit have an inner diameter which is equal to substantially ten millimeters. The inner diameter of four to six millimeters permits to supply the greater part of the consumers by the required amount of the working medium directly from the neighboring mine roof support, and to connect these conduits to the bundle of hoses which is better protected against stonefall. On the mine roof support itself there are only a small number of hoses with an inner diameter equal to ten millimeters.

The invention provides for a possibility of an advantageous combination of a direct control with a pilot-control. Only the steps which involve a large amount of the working medium are pilot-controlled, whereas the control of all steps involving a small amount of the working medium is performed directly from the neighboring mine roof support. The specific manner of plug connecting of the bundle of hoses leads to a simple connection of the control unit on the neighboring mine roof support with the consumers on the main mine roof support which is to be displaced. Maintenance and repair works are facilitated. The space which is available for the miners is increased, and thereby their operation especially in the conditions of low power strata is less wearsome.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
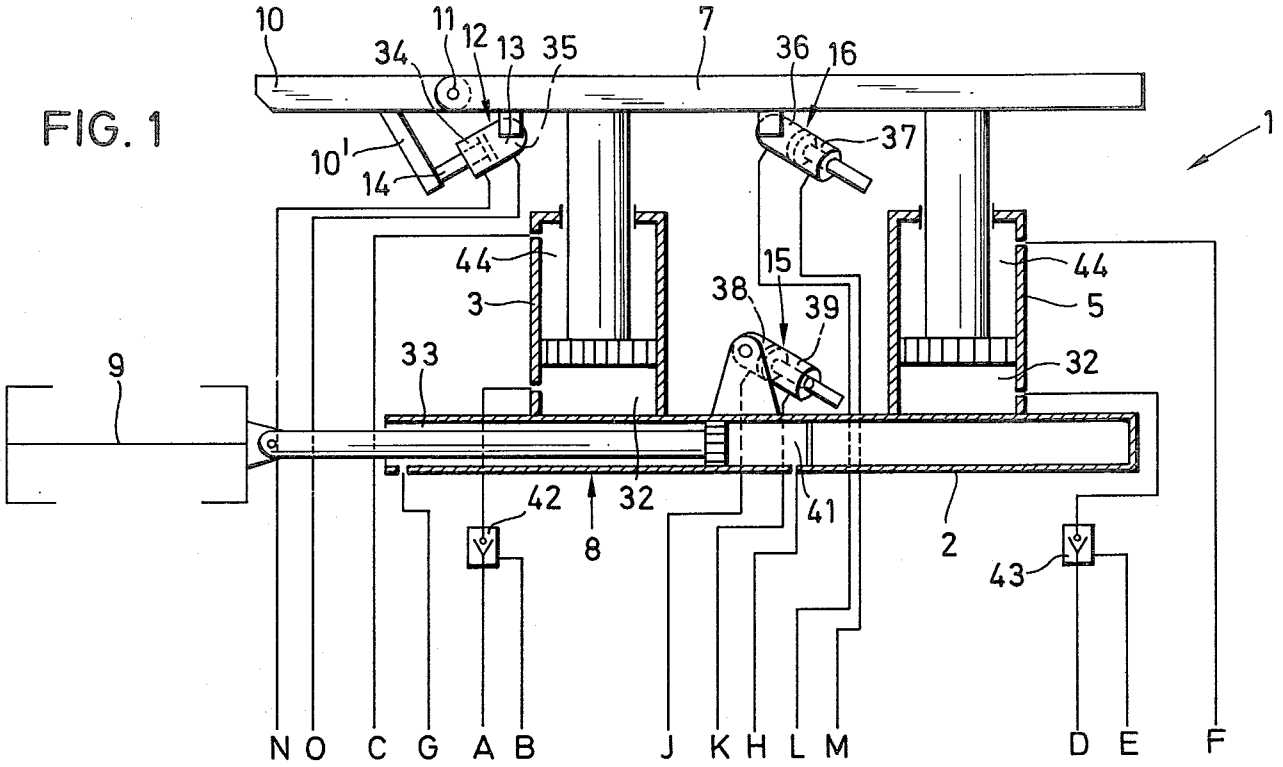
FIG. 1 is a partially sectioned schematic view of a mine roof support which is pivotally connected with a mine conveyor in accordance with the present invention.
Figure 2:
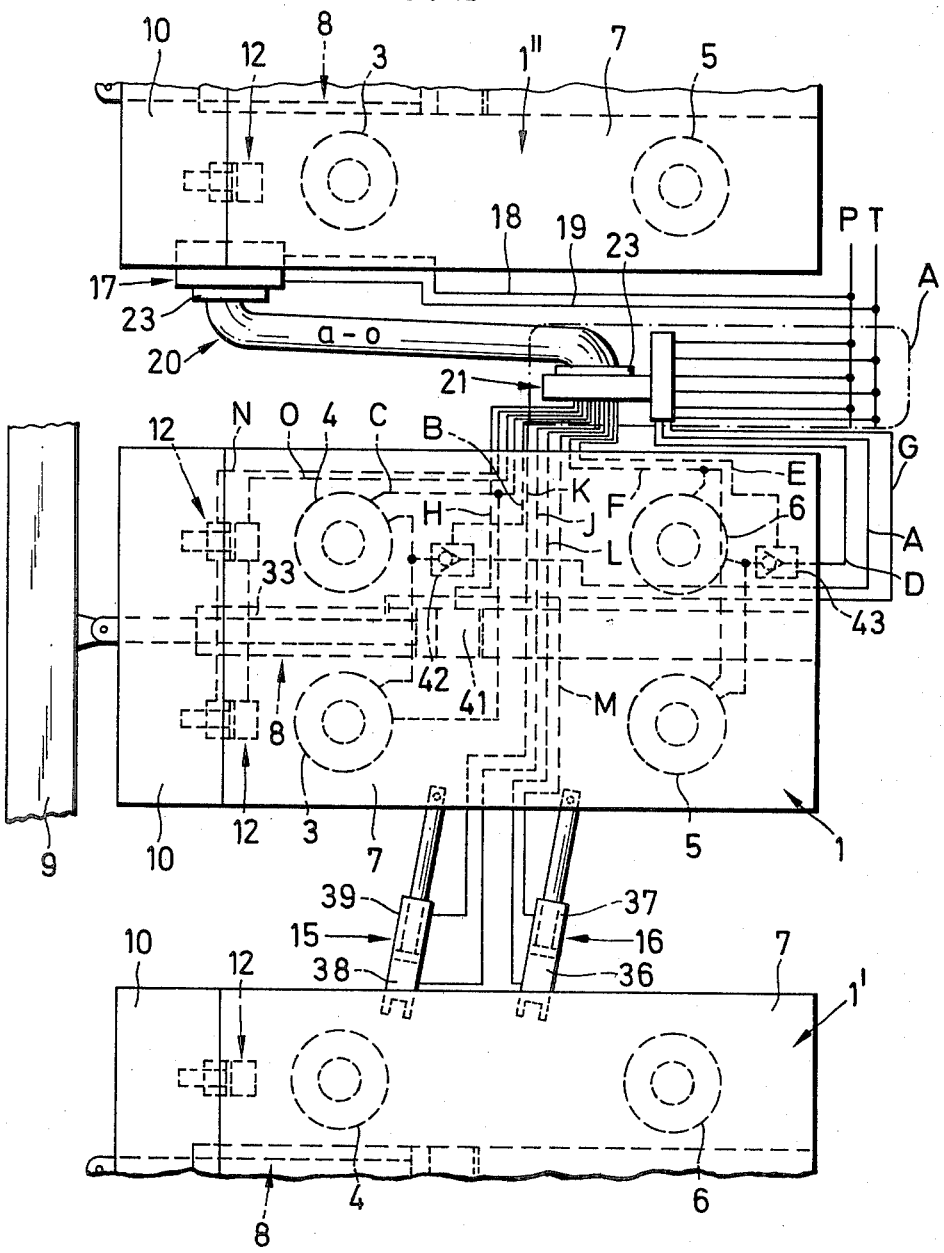
FIG. 2 is a plan view of the mine roof support shown in FIG. 1, together with two neighboring mine roof supports.

FIGS. 1 and 2 show a principle construction of a mine roof support and a control device for various consumers of the mine roof support, in a schematic manner. The mine roof support is identified in toto by reference numeral 1 and has a bottom plate 2, a roof supporting plate 7, and four props 3, 4, 5 and 6 adapted to support the roof supporting plate 7 at different distances from the bottom plate 2. The mine roof support may be formed as a frame, a support, or a shield unit.

The bottom plate 2 forms a displacing unit 8 which is pivotally connected with a mine conveyor 9 at the end of the bottom plate, facing away from the mine face. A front plate 10 is pivotally connected with the roof supporting plate 7 by a vertical hinge 11 at the end of the roof supporting plate facing toward the mine face. The front plate 10 is vertically movable by two tiltable cylinder-and-piston units 12. A housing 13 of each unit 12 is pivotally connected with the roof supporting plate 7, whereas a piston 14 of the same is pivotally connected with a projection 10' which extends downwardly from the front plate 10.

Two neighboring mine roof supports 1 and 1' are held at a distance from one another both in the region of the bottom plate 2 and the roof supporting plate 7 by adjusting cylinder-and-piston units 15 and 16, respectively. This can be seen particularly from FIG. 2. Further such adjusting cylinder-and-piston units may also be provided between the mine support 1 and a neighboring mine roof support 1''. The above mentioned further adjusting cylinder-and-piston units are omitted in the drawings for the sake of clarity.

The control device for the props 3, 4, 5 and 6, and for the units 8, 12, 15 and 16 of the mine roof support 1 comprises, first of all, a multiple-way control unit 17 located on the neighboring mine roof support 1'', as shown in FIG. 2. The construction of the control unit makes possible to select one or several consumers by corresponding return flow of the working medium from the unloaded working spaces. A supply conduit 18 and a withdraw conduit 19 are in communication with a pressure conduit P and a return conduit T for passing the hydraulic working medium. The conduits P and T extend in the longitudinal direction of the mine.

Figure 3:
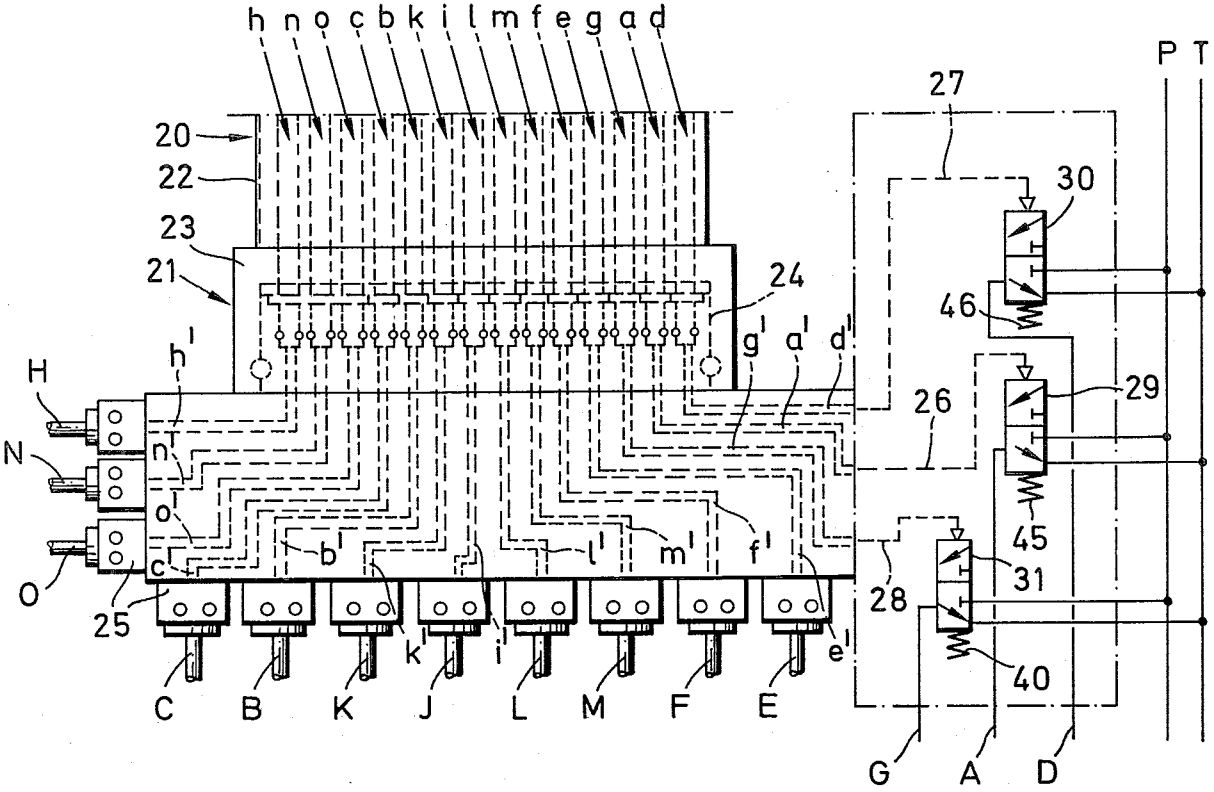
FIG. 3 is a schematic enlarged view of the area of coupling, identified by A in FIG. 2.

A bundle of hoses 20 extends from the control unit 17 to a distributor unit 21 which is arranged on the mine roof support 1, as can also be seen from FIG. 3. In the herein shown embodiment, the bundle 20 includes fourteen hoses from a to o, each having an inner diameter equal to 6 mm. The bundle of hoses is surrounded by a common jacket 22, and at the ends they extend into a plug connector 23.

As can be recognized particularly from FIG. 3, the plug connector 23 overlaps a respectively constructed receiver 24 of the distributor unit 21 so that, each hose from a to o can be connected with a respective passage of a group of passages a' to o' formed in the distributor unit. The similar connection is provided between the bundle of hoses 20 and the control unit 17. As can be seen from FIG. 3, the hoses a to o of the bundle 20 are shown in developed position or, in other words, they are located successively one after the other and adjacent to one another. The distributor unit 21 is also shown in the above mentioned developed position.

Plug coupling elements 25 are provided outside of the distributor unit 21 at the ends of the passages b', c', e', f' and h' to o'. Conduits B, C, E, F and H to O lead from the above-mentioned passages to the consumers which require a small amount of the working medium per time unit, and have an inner diameter which is equal to 6 mm.

As can further be seen from FIG. 3, the passages a', d', g' are connected with conduits 26, 27, 28 which lead to control joints of main control valves 29, 30 and 31. The latter are connected with the pressure conduit P and the return conduit T. Conduits A, D and G which go out of the main control valves, lead to the consumers which require a large amount of the working medium per time unit and have the inner diameter equal to 10 mm.

The latter mentioned consumers are formed by setting spaces 32 of the props 3, 4, 5 and 6 and by a displacement space 33 of the displacing unit 8. These spaces must be supplied with a large quantity of the working medium in a short time in order to attain the required setting pressure for a short time, on the one hand, and to displace the mine roof support fast to a new position so as to support the mine roof, on the other hand.

It can be understood from simultaneous examination of FIGS. 1, 2 and 3, that when the hose n of the control unit 17 is selected, a piston rod space 34 of the tilting cylinder-and-piston unit 12 is subjected to pressure of the working medium through the conduit N, and simultaneously a piston space 35 of the same is relieved through the conduit O. It is possible, on the other hand, by corresponding connection in the control unit to apply pressure of the working medium to the piston space 35 of tilting cylinder-and-piston unit 12 through the conduit O and to thereby relieve the piston rod space through the conduit N.

When pressure is to be applied to a piston space 36 of the upper adjusting cylinder-and-piston unit 16 the hose 1 of the bundle on the control unit is selected, whereby the conduit M leading to a piston rod space 37 serves as a return conduit for the working medium. It is also true for the lower adjusting cylinder-and-piston unit 15 wherein by selection of the hose i a piston space 38 is subjected to pressure of the working medium, and a piston rod space 39 is relieved through the conduit K. When the pressure is to be applied respectively the piston rod spaces of the adjusting cylinder-and-piston units, the hoses m or k on the control unit 17 are selected whereby the conduits L or I serve as discharge conduits.

When it is intended that the mine roof support 1 displaces in a direction of a not shown mine face, while being supported on the mine conveyor, then the hose g on the control unit 17 is selected. The working medium flows through the passage g' into the distributor unit 21 and through the conduit 28 to the control joint of the main control valve 31, and displaces the latter against the force of a spring 40 from the shown position to such a position in which the pressure conduit P is connected with the conduit 6 leading to the piston rod space 33 of the displacing unit 8. The piston rod space is thereby subjected to pressure so that the mine roof support 1, being supported on the mine conveyor 9, is drawn to the mine face. When the displacement terminates, the hose g on the control unit 17 is disconnected, whereby the main control valve 31 is moved to the original position under the action of the spring 40. In this position, the conduit G is connected with the return conduit T.

By selection of the hose h on the control unit, a piston space 41 of the displacing unit 8 are subjected to pressure of the working medium through the conduit H, and particularly so that when the roof mine support is tensioned, it is continuously maintained under pressure of the working medium whereby the mine conveyor is continuously pressed against the mine face.

The relief of the props 3, 4, 5 and 6 before the beginning of the withdrawal process of the mine roof support 1 is performed by selection of the hoses b and e which results in that openable return valves 42 and 43 open into the conduits A and D through the conduits B and E, and the working medium flows out of the setting space 32 of the props. In addition to this, it is also possible that the conduits C and F leading to the piston rod spaces 44 of the props are subjected to pressure of the working medium by respective selection of the hoses c and f on the control unit 17.

When after termination of the withdrawal process the roof mine support is to be set, the hoses a and d on the control unit 17 are selected. Thereby the working medium flows through the passages 26 and 27 to the control joints of the main control valves 29 and 30 and displaces the same against the pressure of springs 45 and 46 to a position in which the pressure conduit P is connected with the conduits A and D. Thereby, the working medium flows into the setting spaces 32 of the props 3, 4, 5 and 6, and the mine roof support is tensioned between the mine roof and the mine sole. Simultaneously, the piston rods 44 of the props are relieved through the conduits C and F. The conduits B and E are also relieved before this. The valves 42 and 43 do not perform their securing function any longer.

After obtaining the required setting pressure, the hoses a and d are again disconnected so that the main control valves 29 and 30 are urged to their original position under the action of the springs 45 and 46. In this position, the conduits A and D are connected with the return conduit T, and the setting spaces 32 are protected by the return valves 42 and 43.

It will be understood that each of the elements described above, or two or more together, may also find a useful application in other types of constructions differing from the types described above.

While the invention has been illustrated and described as embodied in a construction it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A control arrangement for a hydraulically operated mine roof support located adjacent to a neighboring mine roof support and having first consumers which require a smaller amount of a working medium per time unit and second consumers which require a larger amount of the working medium per time unit, said control arrangement comprising first control means for the first consumers which require a smaller amount of a working medium per unit time, said first control means including a first bundle of hoses having a relatively small inner diameter for passing the working medium and arranged to select and to apply pressure to the first consumers directly from the neighboring mine roof support; and second control means for the second consumers which require a larger amount of the working medium per unit time, said second control means including a second bundle of hoses extending between the first-mentioned mine roof support and the neighboring mine roof support, main control valves which are indirectly remotely controlled through said second bundle of hoses and arranged to select the second consumers, and conduits extending between the second consumers and said main control valves and arranged to apply pressure to the former, said conduits having an inner diameter which exceeds the inner diameter of the hoses of said bundles.

2. A control arrangement as defined in claim 1, wherein said first bundle of hoses and said second bundle of hoses together form a joint bundle of hoses.

3. A control arrangement as defined in claim 2, wherein the hoses of said joint bundle have a predetermined inner diameter, the inner diameter of said conduits being from two to three times larger than the inner diameter of the hoses of said joint bundle.

4. A control arrangement as defined in claim 3; and further comprising a multiple-way control unit located on the neighboring mine roof support, and a distributor unit located on the first-mentioned mine roof support, said hoses of said joint bundle connecting said multiple-way control unit with said distributor unit.

5. A control arrangement as defined in claim 4 wherein said main control valves are pilot-controlled; and further comprising additional conduits having a small inner diameter and provided between said distributor unit and the first consumers which require a small amount of the working medium per time unit, said first mentioned conduits having a larger diameter being provided between said distributor unit and the second consumers which require a large amount of the working medium per time unit with interposition of said pilot-controlled main control valves, the inner diameter of said first-mentioned conduits being from two to three times larger than the inner diameter of said additional conduits.

6. A control arrangement as defined in claim 5, wherein said multiple-way control unit and said distributor unit each have a receiving portion; and further comprising two plug connectors spaced from one another, the hoses of said joint bundle having end portions each extending into a respective one of said plug connectors, and one of said plug connectors being connected with the receiving portion of said multiple-way control unit whereas the other of said plug connectors is connected with the receiving portion of said distributor unit.

7. A control arrangement as defined in claim 1, wherein the first-mentioned mine roof support has a plurality of hydraulically operated props each having a piston and a setting space below the piston, and a hydraulically operated displacing unit having a piston and a front space in front of the piston as considered in the direction toward the mine face, the second consumers which require a large amount of a working medium per time unit being formed by the setting spaces and the front space, the hoses of said first bundle being operative for selecting and applying pressure to the setting spaces of the props and the front space of the displacing unit.

8. A control arrangement as defined in claim 5, wherein said additional conduits leading to the first consumers which require a small amount of the working medium per time unit, have an inner diameter equal to substantially between 4 and 6 mm.

9. A control arrangement as defined in claim 8, wherein said further conduits which lead to the consumers which require a large amount of the working medium per time unit, have an inner diameter which is equal to substantially 10 mm.

10. A control arrangement as defined in claim 2, wherein each individual conduit of said joint bundle of hoses is formed as a pressure conduit and a return conduit so as to serve for supplying and withdrawing of the working medium.

11. A mine roof support installation including a hydraulically operated mine roof support having first consumers which require a small amount of a working medium per time unit and second consumers which require a large amount of the working medium per time unit; a neighboring mine roof support located adjacent to said first-mentioned mine roof support; first control means for said first consumers which require a small amount of a working medium per unit time, said first control means including a first bundle of hoses having a relatively small inner diameter for passing the working medium and arranged to select and to apply pressure to the first consumers directly from said neighboring mine roof support; and second control means for all second consumers which require a large amount of the working medium per unit time, said second control means including a second bundle of hoses extending between said first-mentioned mine roof support and said neighboring mine roof support, main control valves which are indirectly remotely controlled through said second bundle of hoses and arranged to select said second consumers, and conduits extending between said second consumers and said main control valves and arranged to apply pressure to the former, said further conduits having an inner diameter which exceeds the inner diameter of the hoses of said bundles.

* * * * *